US006273294B1

(12) United States Patent
Petzold et al.

(10) Patent No.: US 6,273,294 B1
(45) Date of Patent: Aug. 14, 2001

(54) TABLET DISPENSER

(75) Inventors: Werner Petzold; Ludger Südkamp, both of Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 09/463,161

(22) PCT Filed: Nov. 24, 1997

(86) PCT No.: PCT/EP97/06553

§ 371 Date: Jan. 19, 2000

§ 102(e) Date: Jan. 19, 2000

(87) PCT Pub. No.: WO99/07621

PCT Pub. Date: Feb. 18, 1999

(30) Foreign Application Priority Data

Aug. 5, 1997 (DE) ..... 297 13 884 U

(51) Int. Cl.[7] ..... B65D 83/00
(52) U.S. Cl. ..... 221/65; 221/263; 221/266
(58) Field of Search ..... 221/65, 263, 266

(56) References Cited

U.S. PATENT DOCUMENTS 4,564,124 * 1/1986 Burton ..... 221/263

FOREIGN PATENT DOCUMENTS 296 01 693 U1 7/1996 (DE) .
0221413 5/1987 (EP) .
0287335 10/1988 (EP) .
WO 91/17103 * 11/1991 (WO) ..... 221/266
WO 94/14682 * 7/1994 (WO) ..... 221/65

* cited by examiner

*Primary Examiner*—David H. Bollinger
(74) *Attorney, Agent, or Firm*—Friedrich Kueffner

(57) ABSTRACT

The invention pertains to a tablet dispenser for distributing tablets in individual portions. The tablet dispenser described in the invention comprises a prismatic enclosure (29), the bottom face (22) of which presents an aperture (21) offset relative to a front face (36), the top face of which is open in its whole cross-section, and the side faces (34, 35) of which have a recess (29) on top. The described dispenser also comprises an internal component (10) with limited displacement, nested into the enclosure (10) by the open top (30) and featuring a tablet feed chamber (12), preferably prismatic, the bottom of which comprises a substantially vertical (13) tablet supply duct extending through the bottom aperture (21) provided in the enclosure (20), as well as a spring (14) resting upon the bottom face (22) of the enclosure and a blade (23) to limit the stroke. In order to substantially improve the safety of operation, a blade is provided on the internal side wall (35) of the enclosure (20) to interact with the external side wall (16) of the internal component (10) when the latter (10) is moving (10). In addition, elements which are arranged in a particularly appropiate manner on the external side faces (15, 16) of the internal component (10) increase the tightness and reduce the frictional resistance between the enclosure (20) and the internal component (10).

7 Claims, 2 Drawing Sheets

TABLET DISPENSER

BACKGROUND OF THE INVENTION

1. Field of the Invention

The invention is directed to a tablet dispenser for giving out tablets in an individually portioned manner, with a prismatic housing whose base surface has a base opening that is offset toward an end face and whose top surface is open over its entire cross section and whose side surfaces each have a cutout at the top, with an inner part which is inserted into the housing through the open top surface and which is displaceable so as to be limited with respect to lift and comprises a preferably prismatic tablet reservoir space, an essentially vertically oriented tablet discharge shaft being provided at the base of the tablet reservoir space and guided through the base opening of the housing, and including a spring which is supported against the base surface of the housing and a web for limiting lift.

2. Description of the Related Art

Dispensers for giving out tablets in an individually portioned manner by means of a displacement of the inner part into the housing, which displacement is limited with respect to lift, are known, wherein a tablet is discharged through a tablet discharge shaft at the opening on the base side. For instance, a tablet dispenser is described in EP 0 345 413 B1, wherein an individual tablet is dispensed through an opening on the base side in a housing by pressing in an actuating key which is connected with a slide via a centrally arranged actuating shaft. This known dispenser is disadvantageous in that tablet fragments and rubbed off portions exit easily when the dispenser is used and carried, for example, in pockets of clothing, handbags or the like, and accordingly soil the carrying vessel or surroundings.

In order to remedy this disadvantage, it is suggested in GM 296 01 693.4 to arrange gap-closing elements at the housing and at the inner part of a tablet dispenser, wherein the inner part comprises actuating key, slide and connection part. The tablet dispenser known from this reference has a prismatic housing with an open end face and a laterally offset opening in the base surface. An inner part is inserted into the housing from above, this inner part comprising a slide and an actuating key connected by a connection element which, together, form a structural unit in the manner of an inner housing having a tablet reservoir space located in its upper part. By pressing with a finger on the upper part of the actuating key, this inner part is displaced, wherein the slide is slid through the base opening of the housing and releases a tablet. The displacement of the inner part is limited with respect to lift by a crosspiece or web which strikes the housing base during the downward movement of the inner part, so that further downward movement is blocked.

Although gap-closing elements are arranged at the housing as well as at the inner part in this known dispenser, tablet fragments and rubbed off portions can still exit from the dispenser between the side walls of the housing and of the inner part which are displaceable relative to one another when the tablet dispenser is operated, so that the frictional resistance between the side walls sliding against one another can be increased sharply. Further, a liquid film can build up in the narrow gap between the side walls of the housing and of the inner part due to capillary action and, combined with rubbed off tablet portions, can also sharply increase frictional resistance.

In order to prevent bridging within the bulk of tablets, which would impede discharge of an individual tablet, but without shaking the tablet dispenser as is usually done in order to break up formation of bridges, the tablet dispenser known from EP 0 345 413 B1 is constructed with inclined surfaces in the region of the discharge shaft, wherein these inclined surfaces, in combination with the actuation of the slide, provide for an individual discharge of the tablets, so that the risk of breakage of the tablets which is increased by shaking the tablets is reduced.

In order to ensure improved loosening or freeing of the tablets in the upper region of the tablet dispenser also, the housing of the tablet dispenser described in GM 296 01 693.4 is formed at its inside with parallel, vertically oriented ribs projecting inward, wherein these ribs engage in longitudinal slits of the connection element and bring about a loosening of the tablets when the slide moves out of its basic position along the lift out direction into its discharging position.

SUMMARY OF THE INVENTION

Proceeding from this known prior art, it is the object of the invention to further develop the described tablet dispenser for the purpose of reducing the described disadvantages with respect to sealing, friction and, further, the loosening of tablets with high reliability of operation and simple manufacture of the tablet dispenser and without creating additional disadvantages such as increased manufacturing costs or increased risk of tablet breakage.

The stated objective is met for a tablet dispenser for giving out tablets in an individually portioned manner by providing the tablet dispenser with a prismatic housing whose base surface has a base opening that is offset toward an end face and whose top surfaces open over its entire cross section and whose side surfaces each have a cutout at the top, with an inner part being inserted into the housing through the open top surface and being displaceable so as to be limited with respect to upward movement and comprising a preferably prismatic tablet reservoir space, an essentially vertically oriented tablet discharge shaft being provided at the base of the tablet reservoir space and extended through the base opening of the housing, and including a spring which is supported against the base surface of the housing and a web for limiting upward movement, wherein according to the invention, a web is arranged at the inner side wall of the housing and is in a working connection with the outer side wall of the inner part during the displacement of the inner part.

Through the feature of the invention in which a web is arranged at the inner side wall of the housing for loosening the tablet bulk and is in a working connection with the outer side wall of the inner part during the displacement of the inner part, a loosening of the tablet bulk is achieved during use of the dispenser and during the displacement of the inner part into the housing involved in this use. When the tablet dispenser is used and, in so doing, the inner part is pushed into the housing up to a stop by finger pressure so that an individual tablet is released from the tablet discharge shaft, the web according to the invention is pressed laterally in a pulsed manner against a flexible side wall of the inner part, so that a movement (shaking movement) is introduced within the tablet bulk in the inner part. As a result of this shaking movement, tablets fall into the discharge shaft and individual discharge is made possible.

The web is dimensioned in the outer part of the housing in such a way that it is open or free with respect to the outer surface of the inner part in the rest position. It is only when the inner part is pressed down that the web strikes the inclination of the outer surface of the inner part, slides farther upward over this inclination, and presses against the outer surface of the inner part which is accordingly pressed toward the side. When the inner part is returned to the original rest position, the outer surface is suddenly reset as soon as the web leaves the outer surface again over the inclination, so that there is an additional intensive shaking movement depending on resetting speed.

The ribs and slits known from GM 296 01 693.4 are accordingly no longer necessary to bring about a shaking movement inside the tablet bulk. The web is advantageously arranged in the area of the base opening of the housing, that is, in the area of the tablet discharge shaft, because the side wall of the inner part in this region has a greater flexibility due to the absence of a front wall.

Advantageous constructions of the invention are indicated in the subclaims.

By means of the further step, according to the invention, of constructing the side walls of the inner part of the dispenser with a circumferentially projecting rim, the gap between the side walls of the inner part and the side walls of the housing is sealed because, even during actuation of the dispenser, the rim is always located inside of the gap and accordingly ensures a constant sealing. At the same time, the frictional resistance when the side walls slide against one another during actuation of the tablet dispenser is appreciably reduced because only the rim of the inner part still slides on the side surface of the housing. A clamping or jamming effect caused by tablet fragments entering the gap between the side surfaces is extensively prevented by the rim which moves inside the gap and, in doing so, also displaces tablet fragments.

Due to the further step in the invention in which the portion of the side walls of the inner part which slides against the side walls of the housing and which is enclosed by the projecting rim is roughened, the total contact surface of the inner part is reduced because now only the raised portions of the roughened surface can still come into contact with the smooth inner surface of the housing and the static or adhesive friction which otherwise occurs in the smooth surfaces is extensively canceled.

Further, the formation of a liquid film due to capillary action is advantageously suppressed by the roughening of the outer surface of the inner part, so that rubbed off portions of tablet which end up in the gap between the side walls remain dry and, also, no liquid can enter the tablet reservoir space due to the building up of a liquid film.

BRIEF DESCRIPTION OF THE DRAWING

Further advantages, details and features of the invention will be gathered from the following explanations concerning an embodiment example shown in the drawings.

DESCRIPTION OF THE PREFERRED EMBODIMENT

Figure 2:
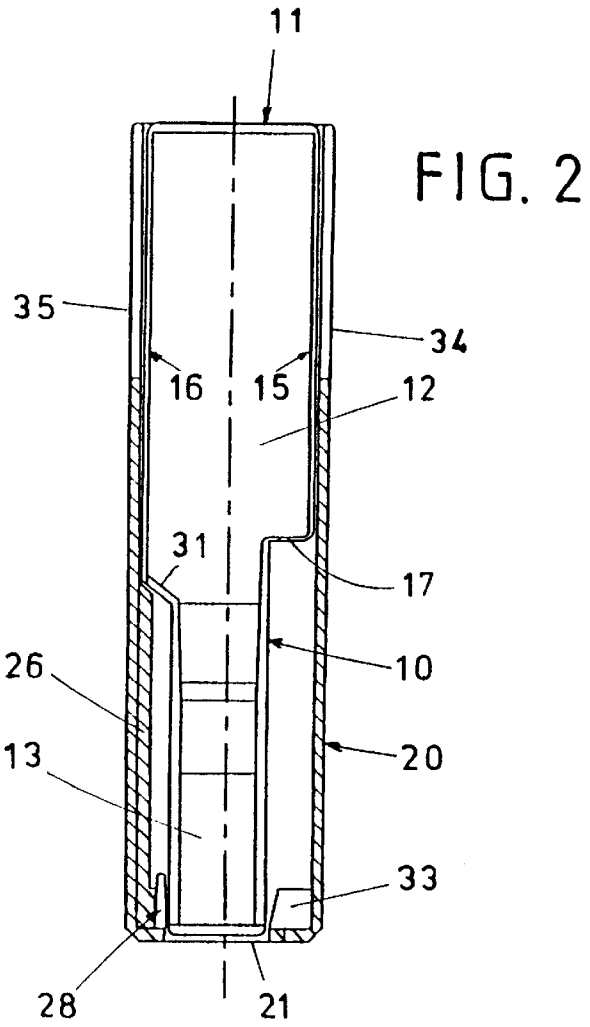
FIG. 2 shows a sectional front view of a tablet dispenser according to the invention with an inner part, in section, pushed into the housing.
Figure 1:
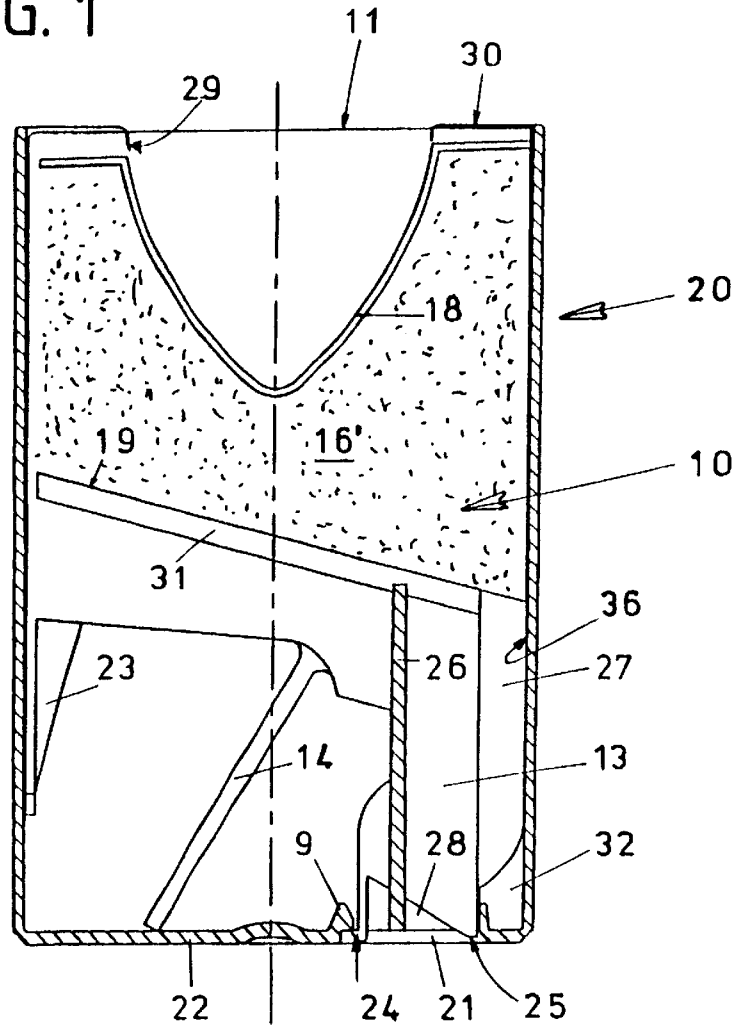
FIG. 1 shows the housing of a tablet dispenser according to the invention in a sectional side view with inserted inner part, not in section.
Figure 4:
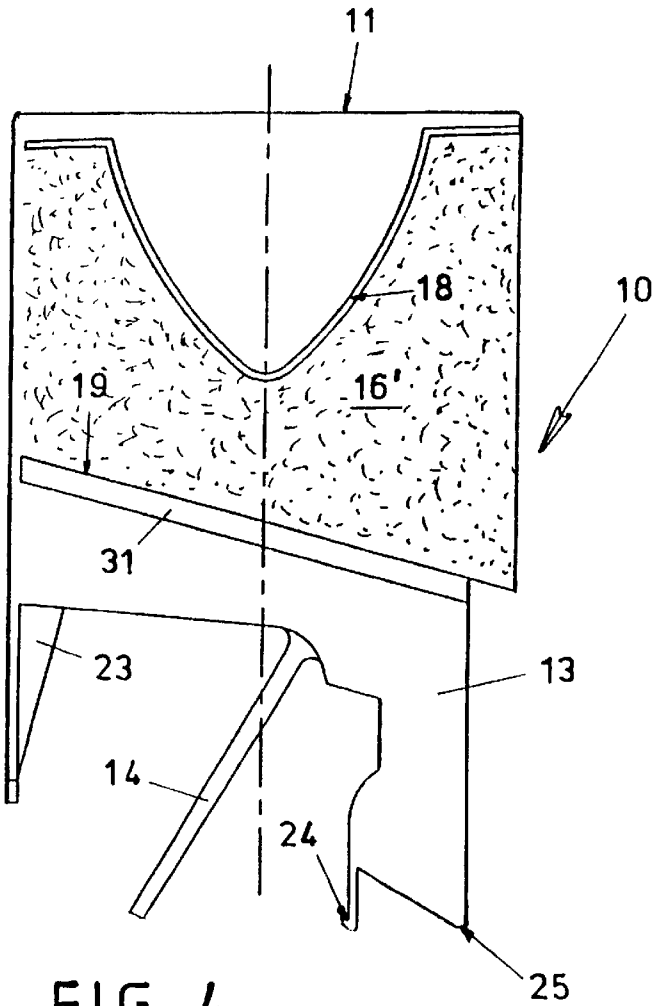
FIG. 4 shows the inner part of a tablet dispenser according to the invention in a side view, not in section.
Figure 3:
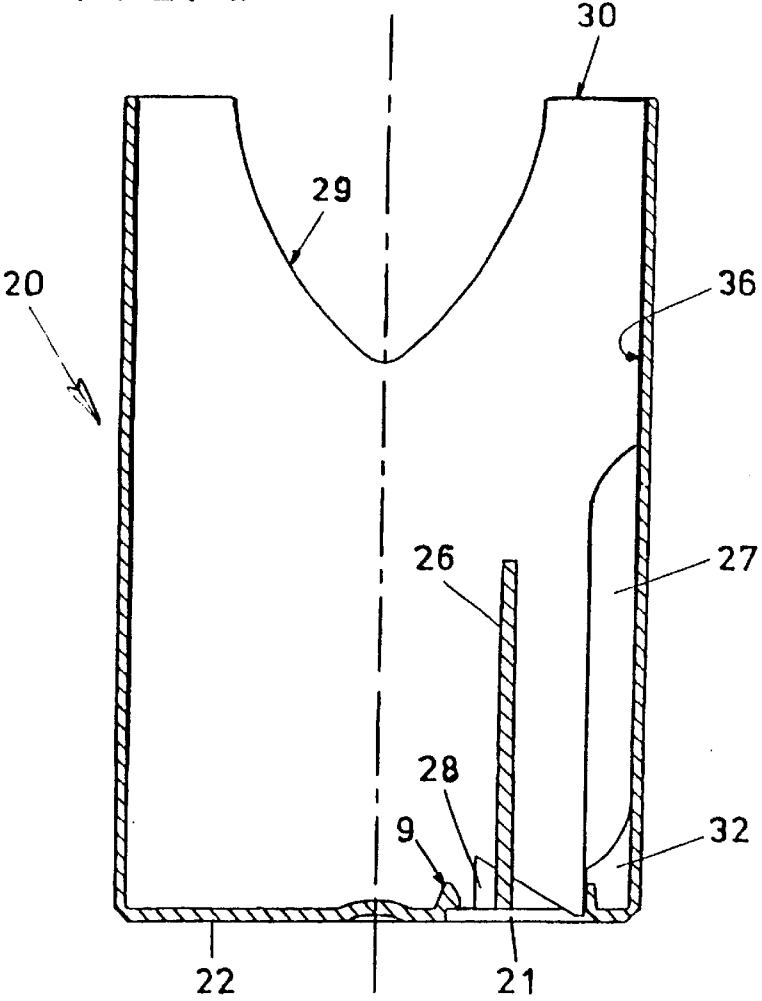
FIG. 3 shows the housing of a tablet dispenser according to the invention in a sectional side view.

The embodiment example according to FIGS. 1 and 2 (the housing (20) and the inner part (10) are shown individually again in FIGS. 3 and 4 for better comprehension) comprises a prismatic housing (20) whose base surface (22) has a laterally offset rectangular base opening (21) and whose top surface (30) is open over its entire cross-sectional surface. The two side surfaces (34, 35) of the housing (20) have, in their upper part, a V-shaped cutout (29), for example, so that the actuation of the tablet dispenser is made possible by displacing the inner part by means of finger pressure.

A web (26) which ends just below the inclination (31) of the inner part (10) is arranged in the area of the base opening (21) at the inner side of the side surface (35) of the housing (20). For purposes of the lateral sealing of the tablet discharge shaft (13), two webs (27) are arranged at the inner end face (36) of the housing (20) as is an inclination (32) for introducing the tablets into the tablet discharge shaft (13). Above the base opening (21), two triangular surfaces (28) form a shaft through which the tablet discharge shaft is guided in its downward movement. The triangular surfaces (28) are supported relative to the side walls (34, 35) by lateral webs (33).

The inner part (10) is inserted into the housing (20) from above, namely, until the spring (14) abuts at the inside of the base surface (22) and the projections of the edges (24, 25) of the tablet discharge shaft (13) slide through the base opening (21) and the edge (24) slides from below under the protuberance (9) of the base opening (21) and hooks with the latter. The base opening (21) is tightly closed by the tablet discharge shaft (13) in this rest position shown in the drawing. The side wall (16) of the inner part (10) is widened by an edge (19) leading diagonally forward to the tablet discharge shaft in order to facilitate a sliding down of the tablets toward the tablet discharge shaft. This edge (19) is not shaped with right angles but, rather, with obtuse angles in the form of an inclination (31). On the other hand, the oppositely located side wall (34) widens at right angles without sloping and parallel to the top surface in the form of a step (17).

The actuation of the tablet dispenser is carried out by pressing with a finger on the end face (11) of the inner part (10), wherein the finger reaches through the cutouts of the side surfaces of the housing, these cutouts being V-shaped in this case, and presses the inner part (10) downward. In so doing, the inner part (10) is displaced until the web (23) abuts at the base surface (22) and a further downward displacement is blocked. As the inner part (10) is displaced downward, the tablet discharge shaft (13) slides downward out of the base opening (21) and a tablet can be removed from the tablet discharge shaft (13) or falls out of the latter, wherein the tablet was transported out of the hollow space (12) inside the upper part of the inner part (10) into the tablet discharge shaft (13) by force of gravity.

When the finger pressure is relaxed, the inner part (10) is pressed by the spring (14)—which slides along the lower base surface (22) during the downward movement of the inner part (10) and, in doing so, flexes and builds up a tension—into its initial position again by reduction of this tension.

In order to reduce the frictional resistance during the actuation of the tablet dispenser and to seal the gap between the lateral inner walls of the housing (20) and the lateral outer walls (15, 16) of the inner part (10), the outer walls (15, 16) are formed with a projecting circumferential rim (18) which seals the gap formed by the side surfaces (15, 16) and the side surfaces of the housing (20), wherein the rim (18) also follows the contour of the cutout of the side surface of the housing (20), which cutout is V-shaped in this case.

Further, the outer side surfaces (15, 16) are roughened in the upper areas (16') forming a gap with the side walls of the housing (20), so that the inner surfaces of the housing only still contact the circumferential rims (18) and the raised portions of the roughening (16') when the tablet dispenser is actuated, so that the frictional resistance is considerably reduced.

When the inner part (10) is displaced downward—in order to release a tablet—the edge (19) is displaced, according to the invention, with its inclination (31) over the web (26), so that the side wall (16) of the inner part is pressed inward in a pulsed manner and so that the tablets located in the hollow space (12) of the inner part (10) are loosened.

During the subsequent displacement of the inner part (10) back into the initial position (rest position), the side walls (15, 16) quickly return to their original position when the web (26) releases the side wall (16) again via the inclination (31). A loosening of the tablet bulk is also carried out again in this way.

Accordingly, there results a simple and effective step for the simultaneous loosening of the tablets during the actuation of the tablet dispenser which can be realized without special constructional expenditure, so that the elaborate steps in GM 296 01 693.4 in the form of a plurality of webs and slits with the consequent disadvantages (increased friction between the inner part and housing, increased risk of breakage by the webs engaging in the slits) can be done away with.

Accordingly, in comparison with the known tablet dispensers, the tablet dispenser according to the invention is distinguished by a simplified construction with high operating reliability, improved sealing, reduced frictional resistance and automatic loosening of the tablet bulk.

The invention is not limited to the embodiment example shown in the drawings. For instance, the shape and course of the circumferentially extending rim (18) corresponding to a modified construction of the tablet dispenser, for example, diverging from the prismatic shape, can be adapted to this altered construction according to the invention. Also, not only one area (16') of the outer side surface (15, 16) of the inner part (10), but also additional surfaces beyond these areas can also be roughened if advantageous in technical respects relating to manufacture. Also, with respect to the construction and arrangement of the web (26), other embodiment forms are possible, insofar as the basic idea of the invention, namely, that the loosening of the tablet bulk is realized by pulse-like lateral displacement of a side wall of the inner part, is met.

What is claimed is:

1. Tablet dispenser for giving out tablets in an individually portioned manner, with a prismatic housing (20) whose base surface (22) has a base opening (21) that is offset toward an end face (36) and whose top surface (30) is open over its entire cross section and whose side surfaces (34, 35) each have a cutout (29) at the top, with an inner part (10) which is inserted into the housing (20) through the open top surface (30) and which is displaceable so as to be limited with respect to upward movement and comprises a preferably prismatic tablet reservoir space (12), an essentially vertically oriented tablet discharge shaft (13) being provided at the base of the tablet reservoir space (12) and extended through the base opening (21) of the housing (20), and including a spring (14) which is supported against the base surface (22) of the housing (20) and a first web (23) for limiting the upward movement of the inner part wherein a second web (26) is arranged at an inner side wall (35) of the housing (20) and is in a working connection with a first outer side wall (16) of the inner part (10) during the displacement of the inner part (10).

2. Tablet dispenser according to claim 1, wherein the second web (26) is arranged in the area of the base opening (21) of the housing (20).

3. Tablet dispenser according to claim 1, wherein the second web (26) is constructed in such a way that it has no contact with the first outer side wall (16) of the inner part in a rest position of the tablet dispenser.

4. Tablet dispenser according to claim 3, wherein the first outer side wall (16) of the inner part (10) above the upper end of the web (26) widens with an inclination (31).

5. Tablet dispenser according to claim 1, wherein the inner part (10) has a second outer side wall (15) and wherein elements (18, 16') for increasing sealing and for reducing frictional resistance between the housing (20) and the inner part (10) are arranged at the first and second outer side walls (15, 16) of the inner part (10).

6. Tablet dispenser according to claim 5, wherein the elements (18) are projecting rims of the outer side wall (15, 16), wherein the rims define the outer side walls surfaces (15, 16) of the inner part (10) corresponding to the shape of an upper contour of the housing (20).

7. Tablet dispenser according to claim 5, wherein the elements (16') are roughened surface regions of the outer side walls (15, 16).

* * * * *